US005646364A

United States Patent [19]

McClung et al.

[11] Patent Number: 5,646,364

[45] Date of Patent: Jul. 8, 1997

[54] EXPLOSIVE DEVICE FOR USE IN UNDERWATER DEMOLITION OPERATIONS AND METHOD THEREFOR

[75] Inventors: Kevin R. McClung, Paulden, Ariz.; Donald Lee Chastain, 3124 E. Oak Hill St., Sierra Vista, Ariz. 85635

[73] Assignee: Donald Lee Chastain, Sierra Vasta, Ariz.

[21] Appl. No.: 491,729

[22] Filed: Jun. 19, 1995

(Under 37 CFR 1.47)

[51] Int. Cl.[6] ..... F42B 22/00

[52] U.S. Cl. ..... 102/406; 102/293; 102/401; 102/411; 224/183; 224/605; 224/931; 224/935

[58] Field of Search ..... 102/282, 293, 102/401, 406, 411; 206/3; 224/183, 605, 628, 635, 931, 934, 210, 211

[56] References Cited

U.S. PATENT DOCUMENTS

| | | | |
|---|---|---|---|
| 1,714,819 | 5/1929 | Rhodes | 224/635 |
| 3,713,299 | 1/1973 | Duncan | 405/186 |
| 3,827,359 | 8/1974 | Daughenbaugh | 102/406 |
| 3,842,611 | 10/1974 | Anderson | 405/186 |
| 3,863,568 | 2/1975 | Frederick | 102/406 |
| 4,635,554 | 1/1987 | Palmer | 102/411 |
| 4,808,033 | 2/1989 | Belmonte | 405/186 |
| 5,362,022 | 11/1994 | McLoughlin et al. | 224/628 |

FOREIGN PATENT DOCUMENTS

| | | | |
|---|---|---|---|
| 2128302 | 4/1984 | United Kingdom | 102/406 |

*Primary Examiner*—Harold J. Tudor

*Attorney, Agent, or Firm*—Harry M. Weiss; Jeffrey D. Moy; Harry M. Weiss & Associates, P.C.

[57] ABSTRACT

An explosive device for attachment to a user engaged in underwater demolition operations is disclosed comprising, in combination, an explosive charge, a buoyant carrier for carrying the explosive charge, and a detonator for detonating the explosive charge. The buoyant carrier includes a variable ballast pouch containing lead shot which can be removed therefrom using a control valve, thereby permitting fine control of the overall weight of the explosive device. The buoyant carrier also includes a plurality of magnets and/or suction cups for permitting the explosive device to be attached to a swimmer's backpack or to either a target surface.

17 Claims, 2 Drawing Sheets

EXPLOSIVE DEVICE FOR USE IN UNDERWATER DEMOLITION OPERATIONS AND METHOD THEREFOR

BACKGROUND OF THE INVENTION

1. Field of the Invention

This invention relates generally to explosive devices and, more specifically, to an explosive device for attachment to a user engaged in underwater demolition operations and methods therefor.

2. Description of the Related Art

Special Operations forces, such as the U.S. Navy SEALS (Sea, Air, and Land), are often required to carry large quantities of demolitions over land and/or through the sea. Currently, an individual engaged in underwater demolition operations must carry a cumbersome satchel or haversack containing explosives. This method of delivering an explosive charge to a target is very inefficient. For example, often times an individual engaged in underwater demolition operations must swim long ranges in order to reach the desired target. A swimmer carrying an explosive haversack with one arm is obviously limited to using only the other arm for swimming. Thus, one can imagine that such a swimmer would tire relatively quickly, thereby effectively reducing the range over which a swimmer can safely traverse. Additionally, the task of underwater navigation is further complicated for a swimmer carrying a cumbersome haversack, because the swimmer has only one free hand for accessing navigational equipment.

Another problem of the prior art method for delivering an explosive device has to do with attempting to obtain a combined neutral buoyancy for the swimmer and the payload under water. Of course, the swimmer and the payload have some total weight. If the total weight is too heavy, the swimmer may tire and sink. If the total weight is too light, the swimmer may float to the surface, thereby potentially revealing position. When maintaining a neutrally buoyant condition, a swimmer can more easily maintain desired depth. Thus, one sees that in order to optimize swimmer covertness and safety, obtaining neutral buoyancy is highly desirable. A current method for a swimmer to attempt to obtain neutral buoyancy while carrying an explosive haversack is for the swimmer to fill an inflatable bladder with a gas until the swimmer maintains the desired depth. The problem with this approach is that if the swimmer changes swimming depth, then the subsequent change in sea pressure changes the buoyancy of the bladder, and, consequently, the swimmer is forced to constantly adjust the amount of gas in the bladder. A better approach would be to create a lightweight, explosive carrier device having a quick, simple manner for adjusting the overall ballast.

Therefore, there existed a need to provide a lightweight, variable ballast, explosive device for attachment to a user engaged in underwater demolition operations. Furthermore, the explosive device should be light enough to be carried on land without excessively tiring the user.

SUMMARY OF THE INVENTION

In accordance with one embodiment of this invention, it is an object of this invention to provide an explosive device for attachment to a user engaged in underwater demolition operations.

It is another object of this invention to provide a method for delivering an explosive device for use in underwater demolition operations.

It is a further object of this invention to provide an explosive device for attachment to a user engaged in demolition operations.

It is another object of this invention to provide a lightweight, variable ballast explosive device for attachment to a user engaged in underwater demolition operations.

It is yet another object of this invention to provide an explosive device for attachment to a user wearing a U.S. Navy MK 46 type backpack.

It is still another object of this invention to provide an explosive device for attachment to a user engaged in underwater demolition operations such that the user can swim using both hands.

It is yet another object of this invention to provide a lightweight, compact explosive device for attachment to a user engaged in underwater demolition operations such that the user's swimming range is maximized.

BRIEF DESCRIPTION OF THE PREFERRED EMBODIMENTS

In accordance with one embodiment of this invention, an explosive device for attachment to a user engaged in underwater demolition operations device is disclosed comprising, in combination, explosive charge means to be delivered by the user to a target for detonation in proximity with the target, buoyant carrier means to be carried by the user for containing the explosive charge means, and detonator means coupled to the buoyant carrier means for detonating the explosive charge means. The device further comprises plate means carried by the user for permitting the attachment of the explosive device to the user. The buoyant carrier means comprises tray means having member portions extending from portions of a perimeter of the tray means for retaining the explosive charge means, and buoyant cover means extending over the member portions and coupled to the tray means for enclosing the explosive charge means. The member portions have a plurality of slots penetrating there through. In addition, the device further comprises retaining strap means coupled between the plurality of slots in the member portions for retaining the explosive charge means against the tray means, and buoyant carrier retaining strap means wrapped around portions of both the tray means and the buoyant cover means for holding the buoyant cover means and the tray means around the explosive charge means. A surface portion of the buoyant cover means has an aperture penetrating there through and the aperture has a cylindrical ring member inserted therein. The cylindrical ring member has a locking slot therein for locking the detonator means. The detonator means is removably coupled to the buoyant cover means, and the detonator means has an extending knob for insertion into the locking slot for permitting the detonator means to detonate the explosive charge means. The device further comprises connection means coupled to a surface of the tray means for connecting the explosive device to one of the plate means and the target. Additionally, the device comprises variable ballast means coupled to the buoyant carrier means for adjusting a total weight of the device. The variable ballast means comprises a plurality of ballast means for providing weight to the explosive device, ballast containment means coupled to the buoyant carrier means for containing the plurality of ballast means, and valve means having a position for keeping the plurality of ballast means within the ballast containment means and having another position for permitting a controlled withdrawal of a portion of the plurality of ballast means from the ballast containment means. Note that the connection means comprises at least one of a plurality of suction cups and a plurality of magnets.

In accordance with another embodiment of this invention, a method of employing an explosive device for attachment to a user engaged in underwater demolition operations is disclosed comprising the steps of providing explosive charge means to be delivered by the user to a target for detonation in proximity with the target, providing buoyant carrier means to be carried by the user for containing the explosive charge means, and providing detonator means coupled to the buoyant carrier means for detonating the explosive charge means. This method further comprises the step of providing plate means carried by the user for permitting the attachment of the explosive device to the user. The step of providing the buoyant carrier means comprises the steps of providing tray means having member portions extending from portions of a perimeter of the tray means for retaining the explosive charge means, and providing buoyant cover means extending over the member portions and coupled to the tray means for enclosing the explosive charge means. The member portions have a plurality of slots penetrating there through. This method further comprises the steps of providing retaining strap means coupled between the plurality of slots in the member portions for retaining the explosive charge means against the tray means, and providing buoyant carrier retaining strap means wrapped around portions of both the tray means and the buoyant cover means for holding the buoyant cover means and the tray means around the explosive charge means. Note that a surface portion of the buoyant cover means has an aperture penetrating there through, and the aperture has a cylindrical ring member inserted therein. Also, the cylindrical ring member has a locking slot therein for locking the detonator means. Furthermore, the detonator means is removably coupled to the buoyant cover means and, the detonator means has an extending knob for insertion into the locking slot for permitting the detonator means to detonate the explosive charge means. This method further comprises the step of providing connection means coupled to a surface of the tray means for connecting the explosive device to one of the plate means and the target. Additionally, the connection means comprises at least one of a plurality of suction cups and a plurality of magnets. This method further comprises the step of providing variable ballast means coupled to the buoyant carrier means for adjusting a total weight of the device. The step of providing the variable ballast means comprises the steps of providing a plurality of ballast means for providing weight to the explosive device, providing ballast containment means coupled to the buoyant carrier means for containing the plurality of ballast means, and providing valve means having a position for keeping the plurality of ballast means within the ballast containment means and having another position for permitting a controlled withdrawal of a portion of the plurality of ballast means from the ballast containment means.

The foregoing and other objects, features, and advantages of the invention will be apparent from the following, more particular, description of the preferred embodiments of the invention, as illustrated in the accompanying drawings.

DESCRIPTION OF THE PREFERRED EMBODIMENTS

Figure 1:
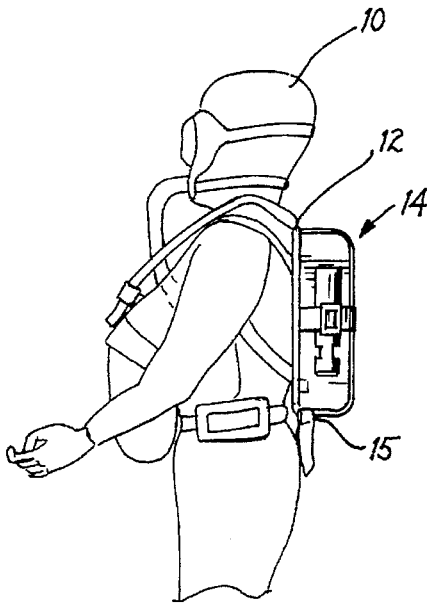
FIG. 1 is a perspective view of a diver carrying the explosive device on a MK 46 backpack.

Referring to FIG. 1, a diver 10 is shown carrying the explosive device 14 on a standard U.S. Navy MK 46 backpack 12. Note that while in a preferred embodiment, the explosive device 14 is carried as shown via the MK 46 backpack 12, other backpacks or carriers could be used. For example, since the MK 46 backpack 12 provides a substantially flat surface for permitting magnets 52 and/or suction cups 38 of the explosive device 14 to attach thereto, it is reasonable that other carriers having a substantially flat surface could be substituted for the MK 46 backpack 12. It may also be possible that a stomach mounted plate analogous to the MK 46 "back" pack 12 could permit the explosive device 14 to be worn on a swimmers stomach. Additionally, it is well known to those skilled in the demolitions field that a second carrier plate attached at 15 can be used with the MK 46 backpack 12, thereby permitting carrying two explosive packages. Thus, if desired, one could implement such well known arrangements for carrying two of the explosive devices 14.

Figure 2:
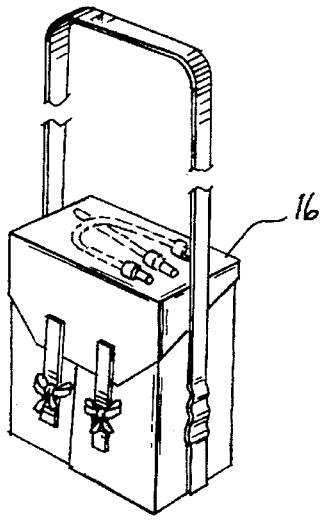
FIG. 2 is a perspective view of an explosive charge assembly.

Referring to FIG. 2, a perspective view of an explosive charge assembly 16 such as the U.S. Navy M183 is shown. In a preferred embodiment, the explosive device 14 is designed to carry the M183, MK 138, or MK 137 explosive charge assemblies, however, other explosive charge assemblies can be accommodated.

Figure 3:
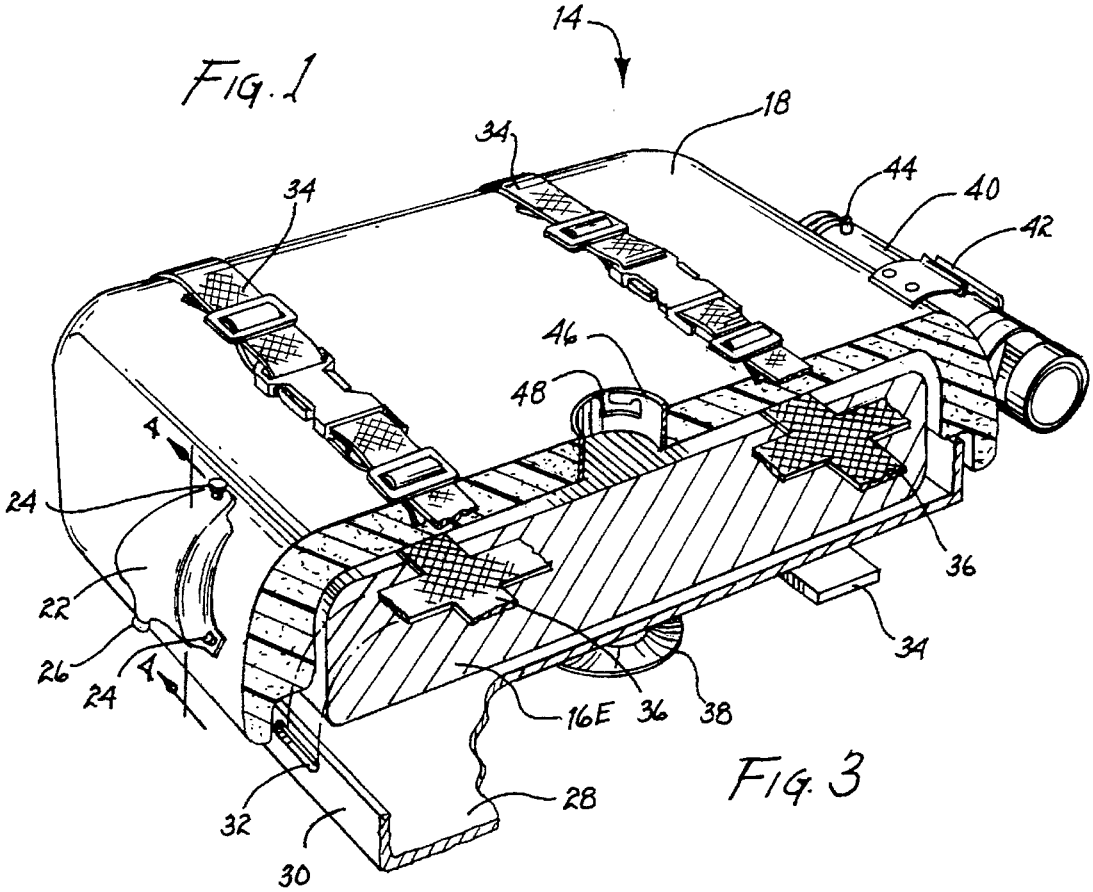
FIG. 3 is a perspective view of the explosive device shown with parts broken away.

Referring to FIG. 3, a side cross-sectional view of the explosive device 14 is shown. An explosive charge 16E, as would be found within the explosive charge assembly 16 of FIG. 2, is contained within the tray 28 and the buoyant cover 18. The explosive charge is to be delivered by a user to a target for detonation in proximity with the target. A buoyant carrier comprising the tray 28 and the buoyant cover 18 is carried by the user via a plate such as the MK 46 backpack 12 (See FIG. 1). A detonator 40 is coupled to the buoyant cover 18 via connecting strap and buckle 42. The detonator 40 is removed from the buoyant cover 18 by opening the connecting strap and buckle 42, and, after removal, the detonator 40 is used for detonating the explosive charge 16E. The tray 28 has member portions 30 extending from portions of the perimeter of the tray 28 for retaining the explosive charge 16E. Note also that the member portions 30 have a plurality of slots 32 penetrating there through, however, in this Figure, only one of these retaining slots 32 is shown. Yet, it is apparent from FIG. 3 that the member portion 30, located opposite the member portion 30 shown having the slot 32, must also have at least one slot 32 in order to permit the connection of the retaining strap 36. Additionally, since the retaining strap 36 provide a perpendicular strap as well, the other member portions 30 (not shown) must also have slots 32 (not shown). It is apparent that the explosive charge 16E is laid into the tray 28, and then the retaining straps 36 are tied over the explosive charge 16E via the slots 32 in the member portions 30. Any suitable manner could be used for connecting the retaining straps 36 with the slots 32. For example, the retaining straps 36 could use fastening buckles such as FASTEX buckles, or alternatively, the retaining straps 36 could use hook and loop type fasteners. The buoyant cover 18 extends over the member portions 30 and is coupled to the tray 28 for enclosing the explosive charge 16E. Buoyant carrier retaining straps 34, provided with FASTEX buckles, are used to wrap around portions of both the tray 28 and the buoyant cover 18 for holding the buoyant cover 18 and the tray 28 around the explosive charge 16E. A surface portion of the buoyant cover 18 has an aperture penetrating there through, and the aperture has a cylindrical ring member 46 inserted therein. The cylindrical ring member 46 has a locking slot 48 therein for locking the detonator 40 in place in order to detonate the explosive charge 16E. The detonator 40 has an extending knob 44 for insertion into the locking slot 48 for permitting the detonator 40 to detonate the explosive charge 16E. Note that while any suitable detonator 40 may be used, in a preferred embodiment, the detonator 40, which is well known in the explosives field, comprises a MK 48 MOD 0 firing device, a MK 39 MOD 0 safety and arming device with an associated retaining plate, and a MK 114 MOD 0 adapter firing device. The explosive device 14 further comprises connectors coupled to a bottom surface of the tray 28 for connecting the explosive device 14 to either a carrier plate worn by a user or to a target. Moreover, these connectors comprise a plurality of suction cups 38 and/or a plurality of magnets 52.

The problems associated with the prior art satchels being heavy and negatively buoyant have been previously disclosed. Consequently, one of the design objectives of the new explosive device 14 was to keep it light and buoyant in water. Specifically, the buoyant cover 18 is made from a hard, lightweight, closed cell polymer foam type material; the tray 28 is made from lightweight aluminum or plastic, and even the straps 34, 36, and 42, and the buckles are made from lightweight nylon and plastic materials, respectively. Thus, the weight of the explosive device 14 is relatively low. In order to add additional weight to the explosive device 14, a variable ballast pouch 22 (or, if desired, a fixed ballast pouch can be used) is coupled to the buoyant carrier 18 via connectors 24. The variable ballast pouch 22 comprises a plurality of ballast pellets 50, such as lead shot, for providing weight, a ballast container or pouch 22 made from Nylon II Neoprene for containing the plurality of ballast pellets 50, and a valve 26 having a position for keeping the plurality of ballast pellets 50 within the ballast container 22 and having another position for permitting a controlled withdrawal of a portion of the plurality of ballast pellets 50 from the ballast container 22. In a preferred embodiment, the valve 26 is a duck bill valve which is normally closed.

Figure 4:
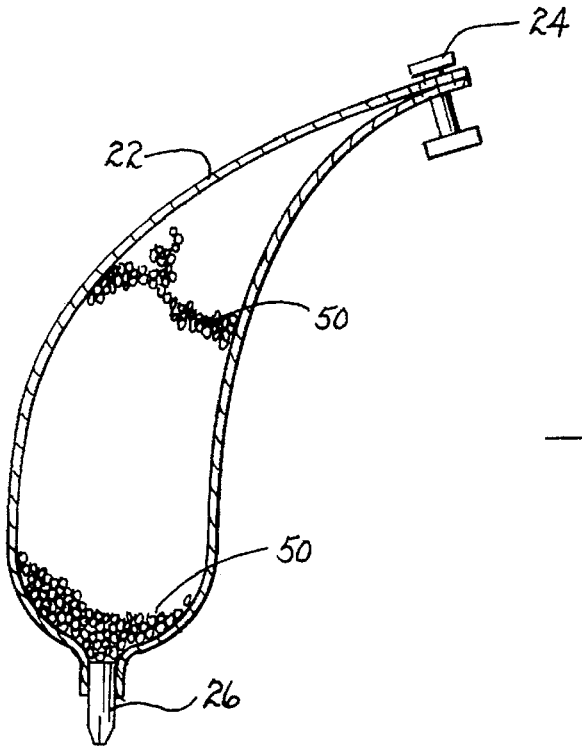
FIG. 4 is a side cross-sectional view of the variable ballast pouch of the explosive device.

Referring to FIG. 4, a side cross-sectional view of the variable ballast pouch or container 22 of the explosive device 14 is shown. The plurality of ballast pellets 50 are shown therein, and the valve 26 is shown in the normally closed position.

Figure 5:
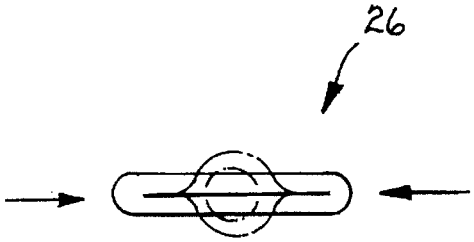
FIG. 5 is a cross-sectional view of the variable ballast pouch valve shown in a normally closed position and also shown, in phantom, in the open position.

Referring to FIG. 5, a cross-section of the valve 26 is shown in the normally closed position. Additionally, the valve is shown, in phantom, in an open position which is used for removing a portion of the ballast pellets 50 from the variable ballast container 22. The arrows represent the application of force upon the valve 26 by a user for opening the valve 26.

Figure 6:
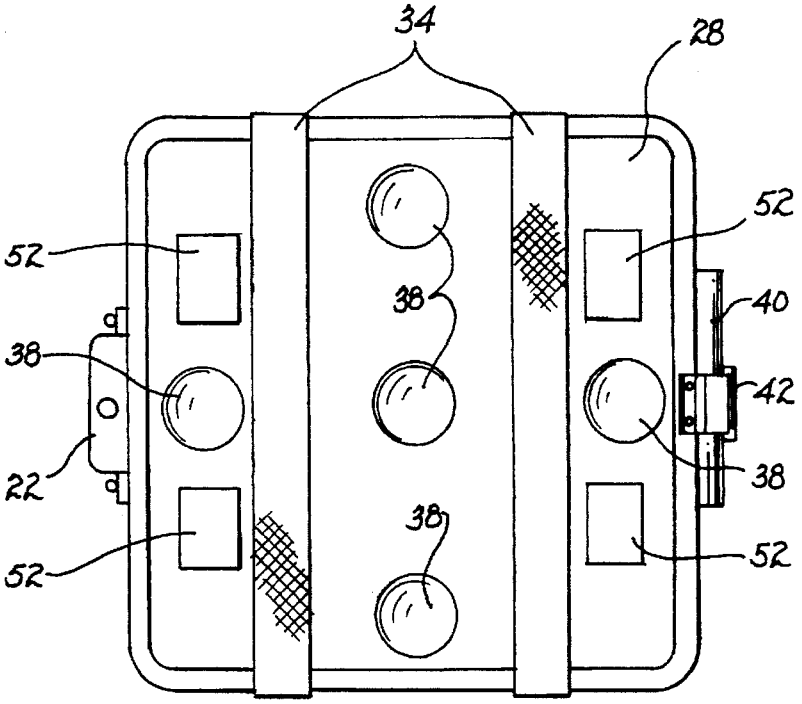
FIG. 6 is a plan view of the back side of the explosive device.

Referring to FIG. 6, a plan view of the back side of the explosive device 14 is shown. In this view, one can see both the plurality of magnets 52 and the plurality of suction cups 38 on the back side of the tray 28. Again, note that a plurality of magnets 52 and/or a plurality of suction cups 38 may be implemented, and, furthermore, any other connectors suitable for connection to both a carrier plate and a target may be used.

Operation

The explosive charge 16E is laid into the tray 28, and then the retaining straps 36 are tied over the explosive charge 16E via the slots 32 in the member portions 30. The buoyant cover 18 extends over the member portions 30 and is coupled to the tray 28 for enclosing the explosive charge 16E. Buoyant carrier retaining straps 34 provided with FASTEX buckles are used to wrap around portions of both the tray 28 and the buoyant cover 18 for holding the buoyant cover 18 and the tray 28 around the explosive charge 16E. Then, the assembled explosive device 14 is attached, using the magnets 52 and/or the suction cups 38, to a carrier plate such as the MK 46 backpack 12.

After reaching a target, the user, or a user's partner, removes the explosive device 14 from the carrier plate 12 and attaches it to the target. The user also removes the detonator 40 from the connecting strap and buckle 42, and inserts and locks the detonator 40, with the extending knob 44, into the locking slot 48 of the cylindrical ring member 46. Then, using techniques well known in the art, the detonator 40 is set to detonate the explosive device 14.

While the invention has been particularly shown and described with reference to the preferred embodiments thereof, it will be understood by those skilled in the art that the foregoing and other changes in form and details may be made therein without departing from the spirit and scope of the invention.

What is claimed is:

1. An explosive device for attachment to a user engaged in underwater demolition operations comprising, in combination:

explosive charge means to be delivered by said user to a target for detonation in proximity with said target;

buoyant carrier means to be carried by said user for containing said explosive charge means;

detonator means coupled to said buoyant carrier means for detonating said explosive charge means;

plate means carried by said user for permitting said attachment of said explosive device to said user;

said buoyant carrier means comprises:

tray means having member portions extending from portions of a perimeter of said tray means for retaining said explosive charge means, said member portions having a plurality of slots penetrating there through; and buoyant cover means extending over said member portions and coupled to said tray means for enclosing said explosive charge means.

2. The device of claim 1 further comprising:

retaining strap means coupled between said plurality of slots in said member portions for retaining said explosive charge means against said tray means; and buoyant carrier retaining strap means wrapped around portions of both said tray means and said buoyant cover means for holding said buoyant cover means and said tray means around said explosive charge means.

3. The device of claim 1 wherein a surface portion of said buoyant cover means has an aperture penetrating there through and said aperture has a cylindrical ring member inserted therein, said cylindrical ring member having a locking slot therein for locking said detonator means.

4. The device of claim 3 wherein said detonator means is removably coupled to said buoyant cover means and wherein said detonator means has an extending knob for insertion into said locking slot for permitting said detonator means to detonate said explosive charge means.

5. The device of claim 1 further comprising connection means coupled to a surface of said tray means for connecting said explosive device to one of said plate means and said target.

6. The device of claim 1 further comprising variable ballast means coupled to said buoyant carrier means for adjusting a total weight of said device.

7. The device of claim 6 wherein said variable ballast means comprises:

a plurality of ballast means for providing weight to said explosive device;

ballast containment means coupled to said buoyant carrier means for containing said plurality of ballast means; and valve means having a position for keeping said plurality of ballast means within said ballast containment means and having another position for permitting a controlled withdrawal of a portion of said plurality of ballast means from said ballast containment means.

8. The device of claim 5 wherein said connection means comprises at least one of a plurality of suction cups and a plurality of magnets.

9. A method of employing an explosive device for attachment to a user engaged in underwater demolition operations comprising the steps of:

providing explosive charge means to be delivered by said user to a target for detonation in proximity with said target;

providing buoyant carrier means to be carried by said user for containing said explosive charge means;

providing detonator means coupled to said buoy-ant carrier means for detonating said explosive charge means;

providing plate means carried by said user for permitting said attachment of said explosive device to said user; the step of providing said buoyant carrier means comprises the steps of:

providing tray means having member portions extending from portions of a perimeter of said tray means for retaining said explosive charge means, said member portions having a plurality of slots penetrating there through; and providing buoyant cover means extending over said member portions and coupled to said tray means for enclosing said explosive charge means.

10. The method of claim 9 further comprising the steps of:

providing retaining strap means coupled between said plurality of slots in said member portions for retaining said explosive charge means against said tray means; and providing buoyant carrier retaining strap means wrapped around portions of both said tray means and said buoyant cover means for holding said buoyant cover means and said tray means around said explosive charge means.

11. The method of claim 9 wherein a surface portion of said buoyant cover means has an aperture penetrating there through and said aperture has a cylindrical ring member inserted therein, said cylindrical ring member having a locking slot therein for locking said detonator means.

12. The method of claim 11 wherein said detonator means is removably coupled to said buoyant cover means and wherein said detonator means has an extending knob for insertion into said locking slot for permitting said detonator means to detonate said explosive charge means.

13. The method of claim 9 further comprising the step of providing connection means coupled to a surface of said tray means for connecting said explosive device to one of said plate means and said target, said connection means comprising at least one of a plurality of suction cups and a plurality of magnets.

14. The method of claim 9 further comprising the step of providing variable ballast means coupled to said buoyant carrier means for adjusting a total weight of said device.

15. The method of claim 14 wherein the step of providing said variable ballast means comprises the steps of:

providing a plurality of ballast means for providing weight to said explosive device;

providing ballast containment means coupled to said buoyant carrier means for containing said plurality of ballast means; and providing valve means having a position for keeping said plurality of ballast means within said ballast containment means and having another position for permitting a controlled withdrawal of a portion of said plurality of ballast means from said ballast containment means.

16. An explosive device for attachment to a user engaged in underwater demolition operations comprising, in combination:

explosive charge means to be delivered by said user to a target for detonation in proximity with said target;

buoyant carrier means to be carried by said user for containing said explosive charge means; and detonator means coupled to said buoyant carrier means for detonating said explosive charge means;

said explosive device further comprising plate means carried by said user for permitting said attachment of said explosive device to said user;

said buoyant carrier means comprising:

tray means having member portions extending from portions of a perimeter of said tray means for retaining said explosive charge means, said member portions having a plurality of slots penetrating there through; and buoyant cover means extending over said member portions and coupled to said tray means for enclosing said explosive charge means;

said explosive device further comprising:

retaining strap means coupled between said plurality of slots in said member portions for retaining said explosive charge means against said tray means; and buoyant carrier retaining strap means wrapped around portions of both said tray means and said buoyant cover means for holding said buoyant cover means and said tray means around said explosive charge means;

said buoyant cover means having an aperture penetrating a surface portion thereof and said aperture having a cylindrical ring member inserted therein, said cylindrical ring member having a locking slot therein for locking said detonator means;

said detonator means being removably coupled to said buoyant cover means and wherein said detonator means has an extending knob for insertion into said locking slot for permitting said detonator means to detonate said explosive charge means;

said explosive device further comprising connection means coupled to a surface of said tray means for connecting said explosive device to one of said plate means and said target, and said connection means comprises at least one of a plurality of suction cups and a plurality of magnets, said explosive device further comprising variable ballast means coupled to said buoyant carrier means for adjusting a total weight of said device;

said variable ballast means comprising:

a plurality of ballast means for providing weight to said explosive device;

ballast containment means coupled to said buoyant carrier means for containing said plurality of ballast means; and valve means having a position for keeping said plurality of ballast means within said ballast containment means and having another position for permitting a controlled withdrawal of a portion of said plurality of ballast means from said ballast containment means.

17. An explosive device for attachment to a user engaged in underwater demolition operations comprising, in combination:

explosive charge means to be delivered by said user to a target for detonation in proximity with said target;

buoyant carrier means to be carried by said user for containing said explosive charge means; and detonator means coupled to said buoyant carrier means for detonating said explosive charge means; said buoyant carrier means comprises:

tray means for retaining said explosive charge means; and buoyant cover means consisting of a buoyant material substantially completely surrounding five sides of said explosive charge means and coupled to said tray means for enclosing said explosive charge means said buoyant cover means having a thickness greater than a thickness of said tray means.

* * * * *